US005609566A

United States Patent [19]

Pupovic

[11] Patent Number: 5,609,566

[45] Date of Patent: Mar. 11, 1997

[54] THE APPARATUS FOR TREATMENT, PHYSICAL THERAPY, REHABILITATION, RECREATION AND TRAINING OF SPINE AND OTHER HUMAN BODY PARTS

[76] Inventor: Milenko Pupovic, F. Filipovica Str. No. 40, 11400 Mladenovac, Yugoslavia

[21] Appl. No.: 141,655

[22] Filed: Oct. 26, 1993

[30] Foreign Application Priority Data

Oct. 27, 1992 [YU] Yugoslavia ..... 937/92

[51] Int. Cl.[6] ..... A61H 1/00

[52] U.S. Cl. ..... 601/23; 601/26; 601/90; 601/93

[58] Field of Search ..... 601/26, 36, 53, 601/58, 98, 23, 24, 49–51, 83–87, 90, 92, 93, 101; 128/781; 482/62, 121, 122, 123, 130, 139, 148, 904, 907; 602/32, 36

[56] References Cited

U.S. PATENT DOCUMENTS

| | | | |
|---|---|---|---|
| 2,130,922 | 9/1938 | Hawley | 601/26 |
| 2,226,881 | 12/1940 | Voiles | 601/93 |
| 2,560,404 | 7/1951 | Assmar | 601/98 |
| 2,984,238 | 5/1961 | Axtell et al. | 602/32 |
| 3,105,489 | 10/1963 | Zivi | 602/32 |
| 3,675,646 | 7/1972 | Corcoran | 602/32 |
| 3,824,991 | 7/1974 | Whitaker | 601/26 |
| 3,960,144 | 6/1976 | Simjian | 601/36 |
| 3,984,101 | 10/1976 | Garza | 601/26 |
| 4,479,646 | 10/1984 | Chirapozu | 601/36 |
| 4,860,733 | 8/1989 | Parker, Jr. | 601/24 |
| 5,070,863 | 12/1991 | McArthur et al. | 601/26 |

FOREIGN PATENT DOCUMENTS

| | | | |
|---|---|---|---|
| 1528483 | 12/1989 | U.S.S.R. | 602/36 |
| 1703097 | 1/1992 | U.S.S.R. | 601/24 |

*Primary Examiner*—Richard J. Apley
*Assistant Examiner*—Jeanne M. Clark
*Attorney, Agent, or Firm*—Shlesinger Arkwright & Garvey

[57] ABSTRACT

Basic elements of the apparatus are a base with patient's seat, and an arched tube fitted behind the seat. The arched tube is connected, via a shaft, to the pedals or electric motor mechanism designed for moving of the arched tube. The arched tube is turned around the shaft beaming point, along helicoidal path contours. On the arched tube there are mounted sliding components fitted with belts or tieing of the upper part of the patient's body, with his/her back rested against the arched tube. The apparatus is fitted also with a mechanism for controlled hand or electric-motor powered extension of the spine of the patient, and with a vibromasseur which is located on the arched tube.

6 Claims, 7 Drawing Sheets

THE APPARATUS FOR TREATMENT, PHYSICAL THERAPY, REHABILITATION, RECREATION AND TRAINING OF SPINE AND OTHER HUMAN BODY PARTS

FIELD OF THE INVENTION

The invention involved is within the scope of devices and equipment used in physical therapy and recreation of the human body. More specifically, the invention relates to an apparatus designed for treatment, physical therapy and recreation of the spine and associated muscles and the body.

BACKGROUND OF THE INVENTION

It is well known that everyday activities of man, under contemporary conditions of life, result in frequent outcome of various spine maladies, and maladies of the associated neck, body and extremities muscles. These maladies, as a rule, are manifesting themselves in form of fatigue, firstly, and with their progressing they start perishing the functions of the spine, nerves and blood vessels and, through all this, the associated muscles. In such cases it is necessary to undertake their treatment and recovery to enable them to assume their functional condition. The integral part of a complete therapy is, certainly, the physical therapy, i.e. the physio-therapeutical or recreative training of the malady-affected parts of the body.

For the purpose of the mentioned physical therapy and recreation, the simplest apparatus have been so far used for extension of the spine. In these devices, the patient's head is tied to an axially moving element, while the patient's legs are fixed to, or rested on, other fixed elements. Gradual extension of the patient's spine, who has been laid down on an attached table, is carried out by hand or hand-controlled motion of an axially-movable head tie-element. For spine extension, adequate weights have been used to maintain extension, achieved by additional force after the completion of the extension cycles.

Disadvantages of such a solution are in that the mentioned solution is not sufficiently universal for treatment of the majority of maladies and deformations of the spine in practice.

One prior art apparatus, much more universal, and known in the engineering art, is described in the non-patent literature as the "TESI" extension system and is manufactured by a company having the same name located in Taufkiches, Federal Republic of Germany. This apparatus is envisaged for complete physical therapy of the spine and comprises a treatment table, complete with a base and a control device, on whose one end there is provided a movable tie-element, with movable belts for patient's head fixation, while on the opposite end of the table there are provided corresponding devices for axial motion of the tie-elements. Elements for heating of the spine, for causing vibration and massage with adequately shaped rolls are also provided. They move axially and radially-wise in relation to the table surface and along the patient's spine following accurately the spine contours.

Disadvantages of this apparatus are in its limited action along the spine axis, and through this, along the associated patient's muscles of neck and body. Namely, the spine of the patient always remains in the axial position, i.e. it cannot be moved in radial - wise or any other direction. This is a statical and passive method of treatment.

In the present engineering art status, there are known so-called training bicycles of various designs, used as independant devices for physical therapy, rehabilitation, recreation and training of the lower parts of the body, particularly of the lower part of the spine, legs and feet muscles.

A disadvantage of these devices is that they cannot be used for any prescribed treatment of the patient's body upper parts.

OBJECTS AND SUMMARY OF THE INVENTION

The present invention is characterized by the following new and inventive elements:

On a base, with a seat for the patient, there is mounted an arched tube immediately behind the seat. This arched tube is supported at its bottom end so that it rotates, with aid of an adequate prime mover and a spindle located under the base, around the vertical shaft axis. The construction makes possible for a sitting patient (user) to be fixed over his/her hip by tie elements to the seat, with his/her back fixed against the arched tube so that his/her spine axis compulsorily follows the arched tube axis.

The rotational motion of the arched tube causes swinging of the patient's body upper parts in all directions, whereby the patient's spine is bent in a manner corresponding to, and following the arched tube.

The therapeutical and recreative effects of such a motion are gained in the circumferential motion of the spine vertibral. In this way, the vascularization of all spine structures and its muscles is improved, which results in increased oxygenation of the sensible structures, such as spinal cord and roots.

For a considerable increase in the therapeutical and recreative effects, the apparatus according to the present invention is also provided with a system for simultaneous extension of the spine. The essence of this part of design is that the tie-elements by which the patient is tied with his/her back against the arched tube are provided to slide along the arched tube. These tie-elements, used for fixation of the head or upper parts of the patient's body to the arched tube, can be fitted with an extension rope. The extension force can be provided by the patient's own hand muscles, or by the therapeutist, or by weights set up on the hand-grip, or by an electric motors. The force is transmitted via rope, through a corresponding system of pulley, to the tie-elements.

The total effect of the simultaneous rotation of the arched tube, to which the patient is tied by his/her back against the tube, and the extension of the patient's spine in the above outlined manner, is unloading of the natural inter-vertibrae space, joints and their bushes, which all act salutarily on the sensitive nerves within the structures, the result of which is reduction or elimination of pain.

This effect is also accomplished by the addition of a vibromasseur device to generate vibrations and which is fitted to the arched tube in the zone of the patient back, neck or head. The vibromasseur vibrations are transmitted, via the arched tube, to the spine and associated muscles of the patient's neck and body, resulting in relaxation of these body parts and in advancement of the therapy.

Therefore, the apparatus according to the present invention causes actions, where applied as designed in the invention, are as follows: circumferential rotation of the patient's spine vertibrae; extension of the patient's spine; massage of the spine and associated patient's neck and body muscles.

It is an object of the present invention to cause improvement and recovery of the muscle strength and mass in case of hypothrophycated muscles after a prolonged application of the apparatus either by active or by passive modes.

Yet a further object is the fast achievement of general condition, strengthening of the respiratory and cardio-vascular system of the patient, sportsmen and patients in post-operative phase, etc. who are using this apparatus.

Another object is physical therapy, i.e. the rehabilitation of the spine and associated muscles of the neck and the body using both passive and the active therapy modes in contrast to other methods, such as electrophoresis, acupuncture, magnetic therapy, etc. that [have been] use predominatly passive modes.

The present invention has resolved the engineering construction problem of the prior art by providing an apparatus characterized by active and passive therapy, rehabilitation, recreation and sport training; circumferential rotation of the spine vertebra due to forceful motion of the spine along a helicoidal path; extension and massage of the spine and associated muscles and muscles of the neck, shoulder and body as well as the extremities of the patient; the possibility of complete and efficient self-control of the apparatus utilization by the patient including control of the spine extension forces; utilization for professional and home treatment of ill or healthy persons, sportsmen, etc.; and simple construction.

Yet another object is to provide a method of physical therapy in treatment of the degenerative maladies of the entire spine, particularly in case of the juvenile deformations of the spine, such as silicoses and hiperkineses and chronical maladies (painful states) in the zone of the lumbo-sacral plexus.

The apparatus, according to the invention, has several design variations. Depending on the age of the patient/user, the arched tube can be longer or shorter. Depending on the spine malady types, the arched tube can be more or less arched. Depending on patient's mobility or in case of the dystrophicated persons or paraplegic persons, the arched tube motion force i.e. the force of the spine extension, can be generated by the patient's own muscles or can be taken from an electric motor.

The variants of the apparatus characterized by the arched tube rotation are caused by the force of the patient's own legs muscles, and the spine extension by the force of the patient's own hand muscles and is therefore suitable for those who can personally follow the therapy progress and the results (noticed through feeling of agreeableness or pains) in order to control by himself/herself the force of motion of the arched tube, i.e. carry out the extension of the spine. At the same time, the patient can use the device for training of the legs or hand muscles.

Further and depending on whether the apparatus is used in home (amateur) application or in professional circumstances, an electric motor can be fitted with electronic devices to program and monitor the therapy.

DETAILED DESCRIPTION OF THE DRAWINGS

DETAILED DESCRIPTION OF THE PREFERRED EMBODIMENTS FIGS. 1, 2

Figure 1:
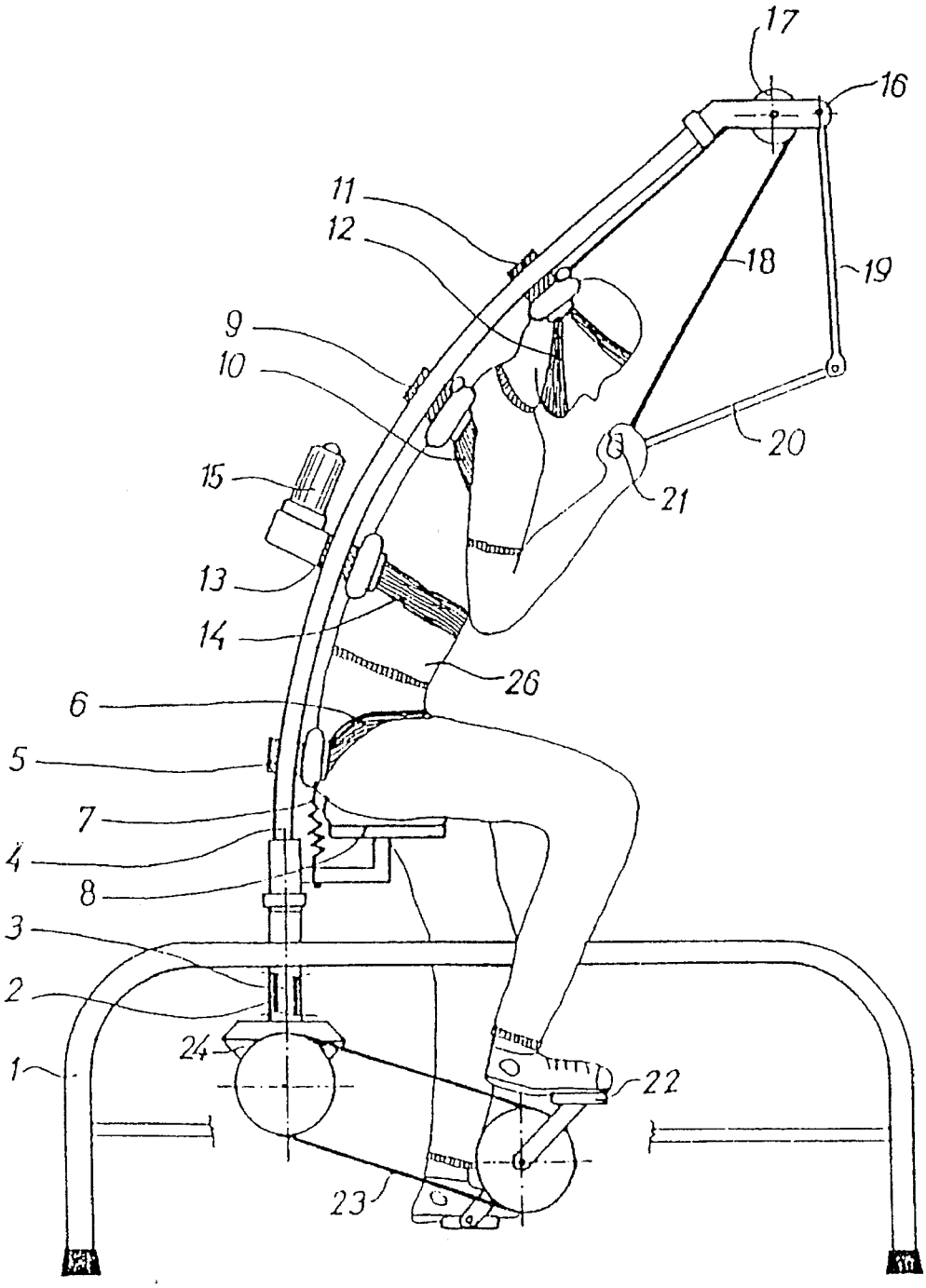
FIG. 1 shows the apparatus with the foot drive, in side view, with partial cross-sections and the arched tube in its basic position (0°)

The base (1) is shown supporting a fixed vertical tube (2) which serves to encase the spindle (3). The spindle (3) is coupled to the arched tube (4). The arched tube (4) is fitted with a slider (5) to fix the patient/user to the arched tube (4) by means of a belt (6) and a spring (7) over patient's hips. The slider (11) on the arched tube (4) serves to tie the patient's head by a special belt for the head (12). The slider (13) on the arched tube (4) bears the belt (14) and a vibromasseur (15). On the top of the arched tube (4) there is provided a bracket (16) that can be rotated on the arched tube (4). On the bracket (16) there is mounted a bearing support pulley (17) over which a non-extensible rope is pulled (18)(or a belt). Also, on the bracket (16) there are mounted two articulated levers (19 and 20). At the end of the articulated lever (20), or at the end of the non-extensible rope (18) there is provided a hand-grip (21).

Figure 2:
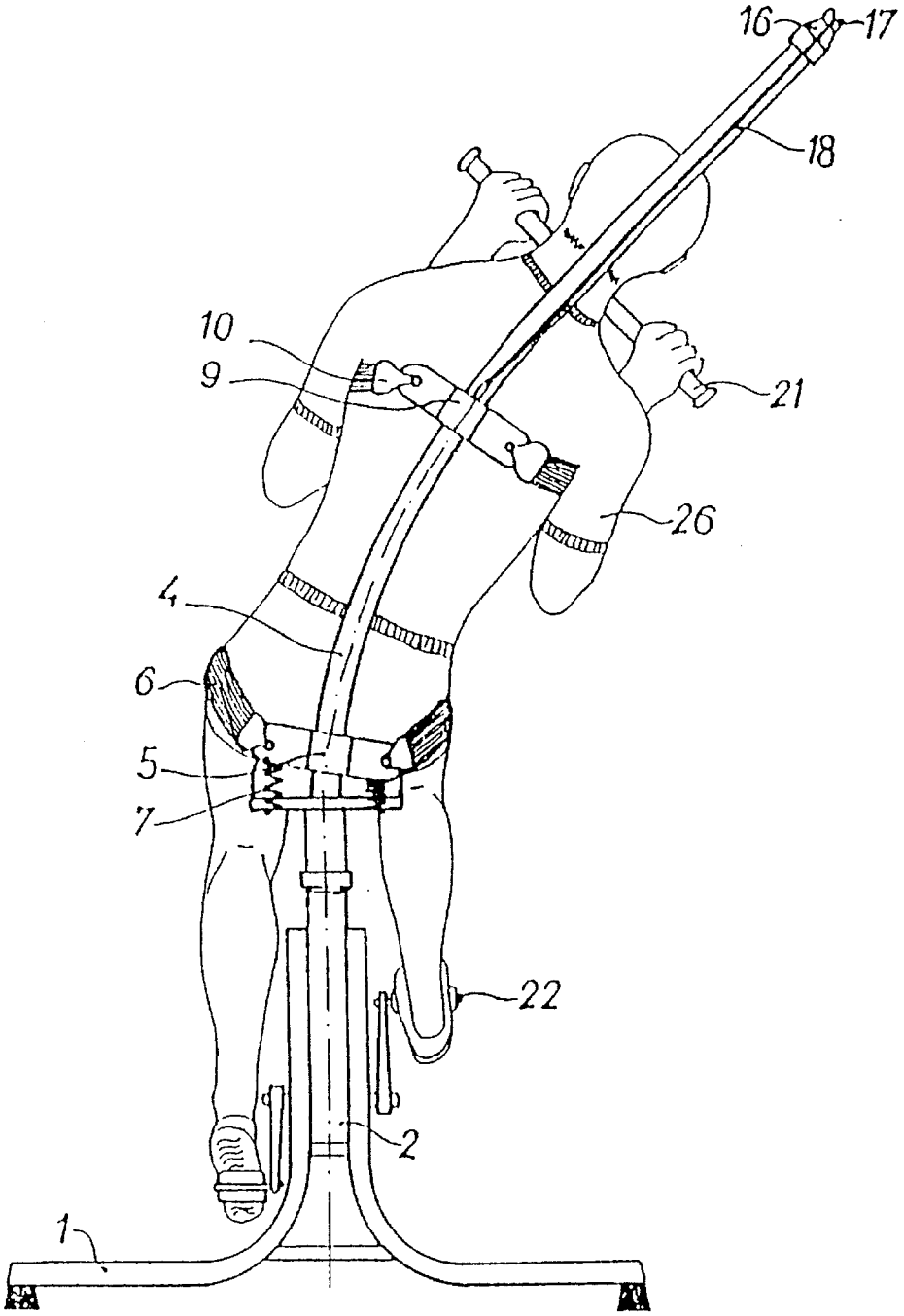
FIGS. 2 shows the apparatus displayed in FIG. 1 above, but in the position where the arched tube is swung by 90°.
Figure 4:
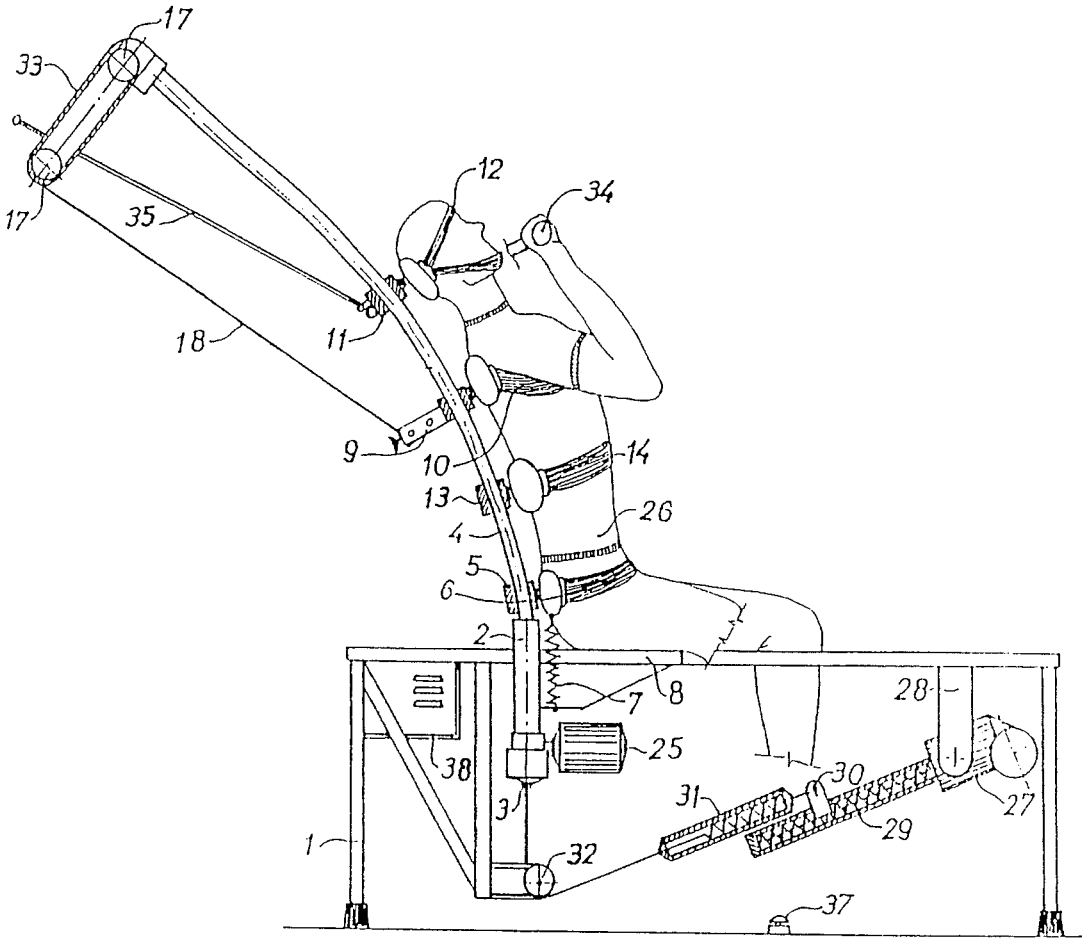
FIG. 4 shows a side view of the apparatus with electric motor drive and with the processor controlled provision and with the arched tube position swung by 180° in relation to the zero position of FIG. 1.

By action of the muscles of the patient's legs upon the pedals (22), torque is transmitted via a belt (23) to the bevel gears (24) (or to any other known provision) and to the shaft (3) that moves the arched tube (4). The patient/user is tied by belts (6, 10, 12, 14) to the arched tube (4) so that the spine follows curvature of the arched tube (4). Views of the possible positions of the patient/user are shown in FIGS. 1, 2 and 4. By tieing of the user with the belt (6) the spring (7) is rigidly connected to the base (1) and to the seat (8) from one side, while the non-extensible rope (18) and head belt (12) from the other side, allow the user to extend the rotation by his/her own hand muscles and with the aid of the hand-grip (21). The extension works especially on the neck portion of the spine, without the need for any external assistance. It is a very important feature that the patient/user can regulate alone the required force for the spine extension with the present invention.

If greater force is desirable for achieving extension of the lumbar region of the spine, the other end of the non-extensible rope (18) is tied to the slider (9) and the belt (10). In such a case all elements of the construction should be dismantled (all elements of the construction are easily disassembled), i.e. the slider (11) and the belt (12) by previous removal of the bracket (16) from the arched tube (4).

The patient extension is performed simultaneously with the rotation of the arched tube (4) and the massage with the vibromasseur (15) whose frequency and intensity are electronically controlled. The arched tube (4) is manufactured with several degrees of curvature, and in various shapes, depending on the patient's age or the kind of the malady.

Where the patient is not able to perform extension by the force of his/her own hands, weights are suspended on the hand-grip (21).

FIGS. 4, 5, 6

A programmed electric motor (27) with preset tensile strength value, is connected to the base (1) with a bracket (28) to perform tensioning by the threaded spindle (29) via a nut (30) that is moving reciprocally along the threaded spindle (29), of the non-extensible rope (18) that is tied by one of its ends to the tensioning spring (31) and passed over the bearing supported pulley (32) and through the shaft (3), the arched tube (4), and again over the bearing supported pulleys (17) mounted on a rotating bracket (33). By its other end it is tied to the slider (11) or the slider (9) that serves for extension of the patient over the belt (12) or (10). The function of the articulated levers (19 and 20, FIGS. 1 and 2) is replaced in this case by the bar (35, FIGS. 4, 5), while the hand grip is directly tied to the slider (11).

Figure 5:
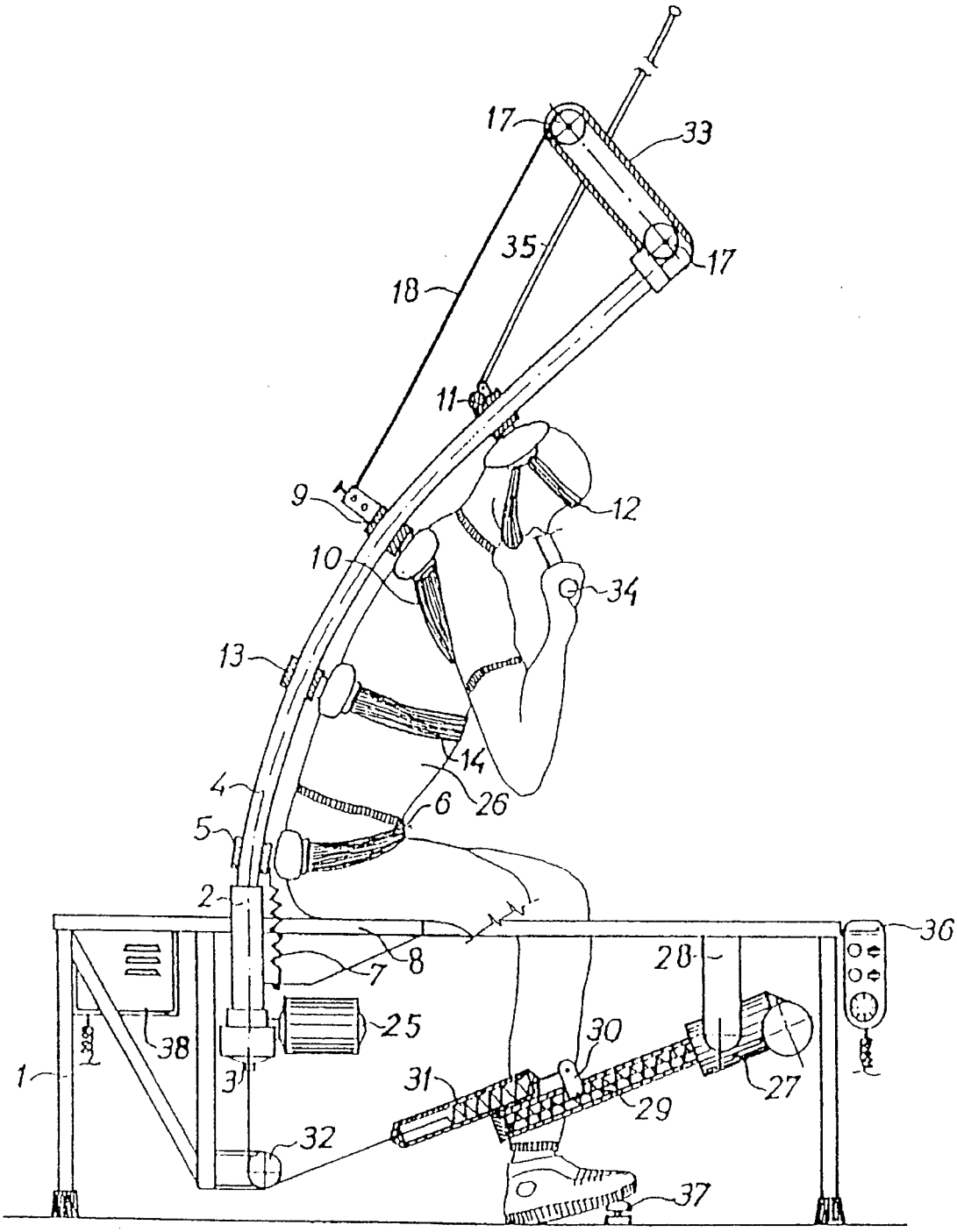
FIG. 5 shows the apparatus of FIG. 4 with the arched tube in the zero position.
Figure 6:
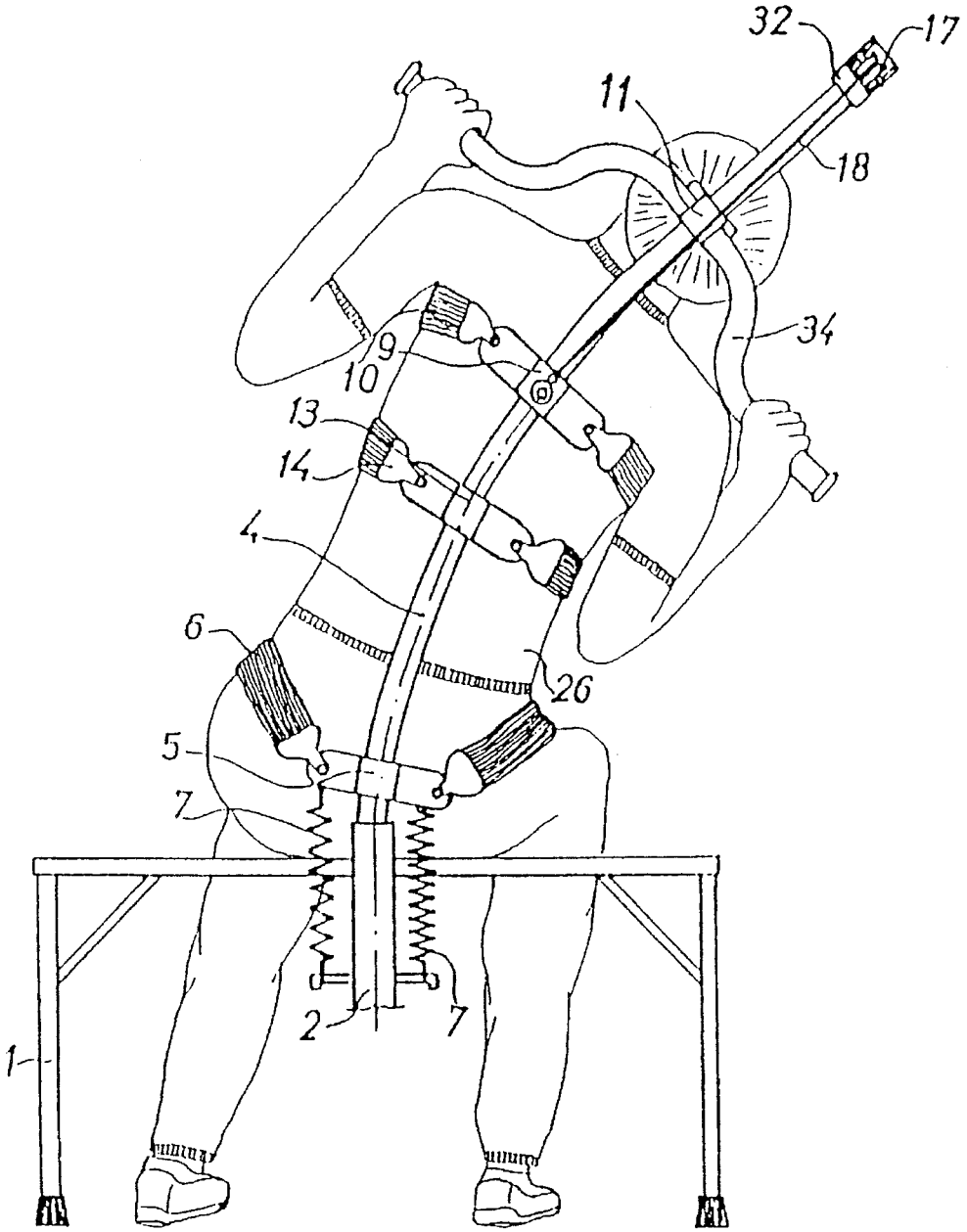
FIG. 6 shows a rear view of the apparatus in FIGS. 4 and 5, with the arched tube swung by 180° in relation to the zero position.
Figure 7:
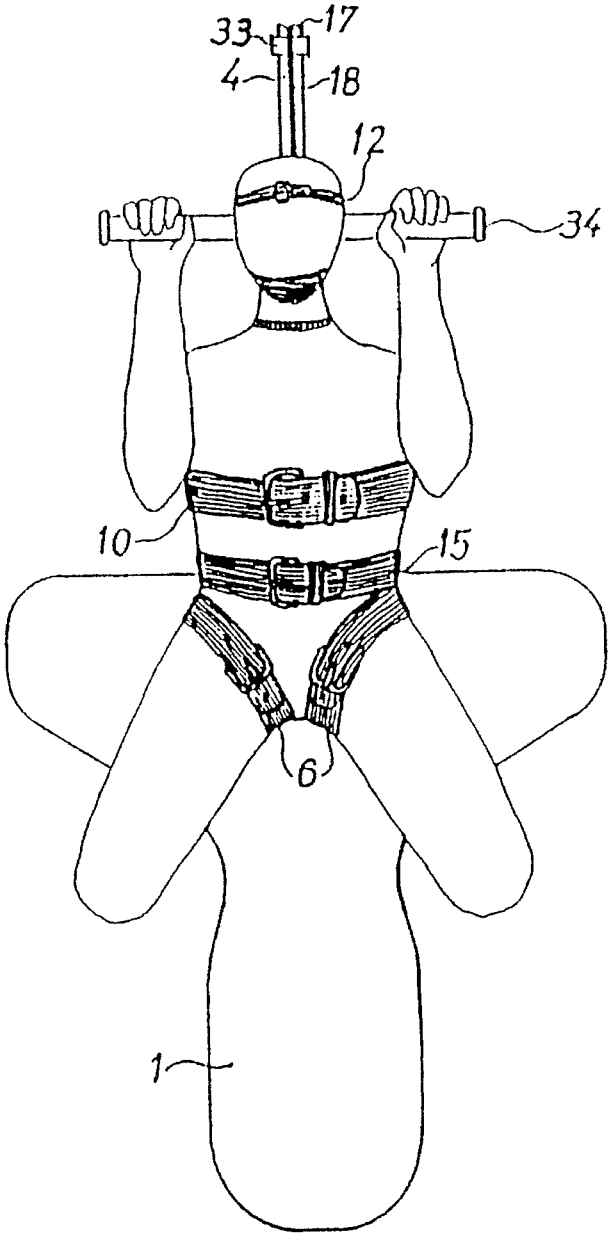
FIG. 7 shows apparatus of FIGS. 4, 5 and 6, in its upper view, with the arched tube (4) swung by 180°.

In this design variant of the apparatus as shown in FIGS. 4, 5 and 6, the arched tube (4) is driven by a controlled electric motor (25).

Figure 3:
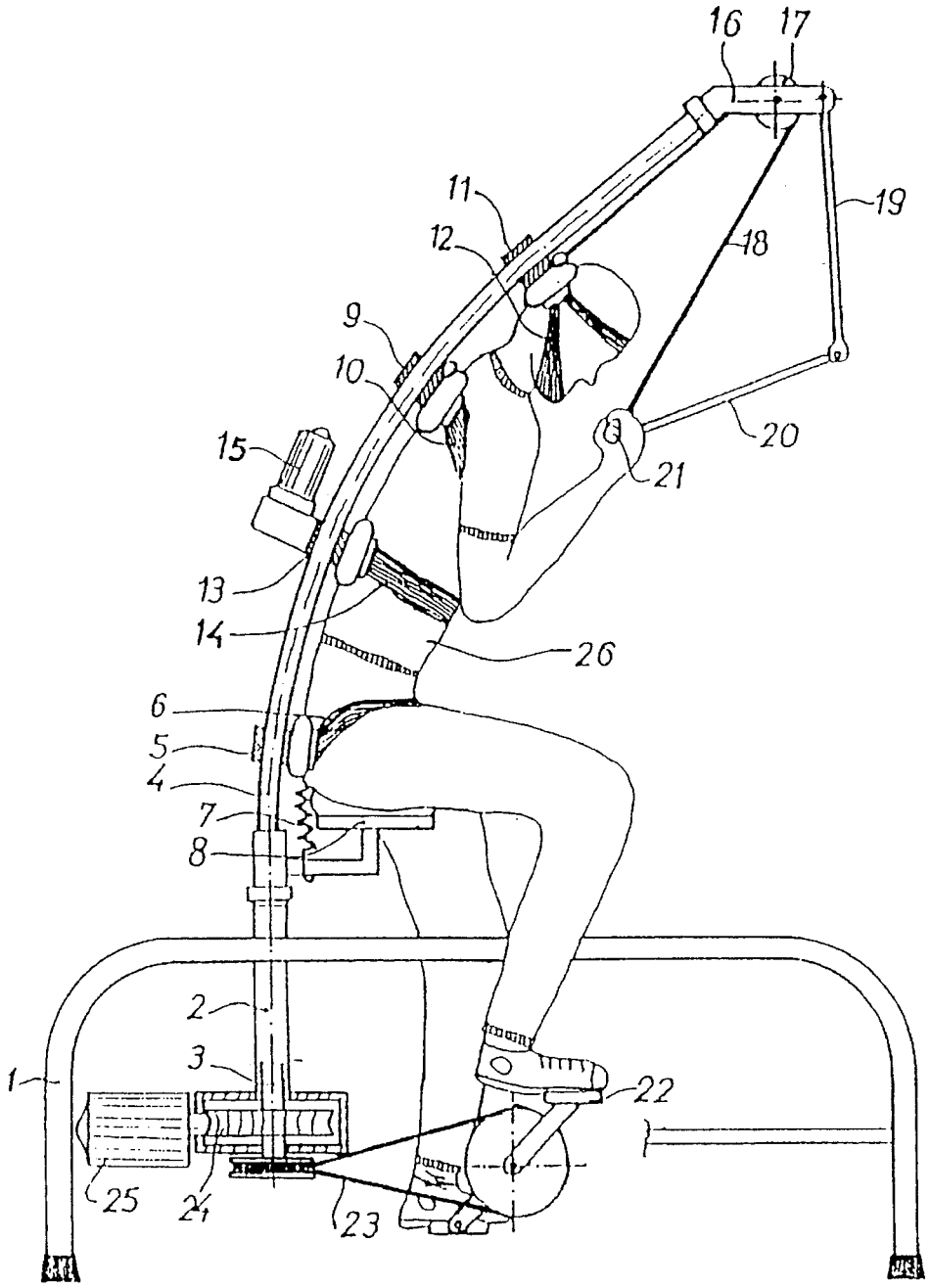
FIG. 3 shows the apparatus of FIGS. 1 and 2 with electric motor drive and mechanical extension provision.

By combination of the previously described design variants, there is obtained an apparatus shown in FIG. 3.

An electric motor (25) is used as the prime mover, so that the torque is transmitted both to the arched tube (4) and to the pedals (22). The patient/user in such a case has to give some resistance to the pedals and to attain in this manner the recreation, rehabilitation, or training of the patient/user's lower extremities.

In use, the patient is provided a special waistcoat (26) to uniformly distribute the rate of forces and assume the position as shown in FIG. 4. The belts (6, 10, 12, 14) are then tensioned and the apparatus is set into operation. The electric motor (25) is switched on to move the arched tube (4). While the arched tube (4) is rotating along the helicoidal path, the electric motor (27) is slowly started up. It gradually increases the tensioning force until it reaches its preset value.

An expert must be present always during the treatment process of this embodiment.

Regulation of the electric motor running times, operation sequences and all other elements including Tensile strength/force (electric motor 27), Arched tube r.p.m. (electric motor 25), Torque (electric motor 25), Frequency and intensity of the vibromasseur (electric motor 15), Left-hand cycle duration time, Right-hand cycle duration time, and Total-hand cycle duration time are performed by a microprocessor unit or in any other mode known in the art.

FIG. 5 shows an electrical box (38) serving as a power supply to the apparatus, a control board (36) and a safety switch (37) to stop the system by the patient in the event of intensified pains.

The apparatus of this embodiment is especially applicable for patients that have no control of their hands and/or legs (paraplegy, quadroplegy, dystrophy sufferers) or have very weak control thereof.

The patient may grip the hand-grip when his/her hands are tied to the hand-grip (34). The physician or the therapeutist controls the rotation of the arched tube (4), and the spine extension process by a control board (36).

What I claim is:

1. A therapeutic exercising device comprising:

a) a base member;

b) an elongated arched member having first and second ends, said arched member is fixed to said base member at said first end and extends generally transverse to said base member, said arched member is adapted to selectively rotate about its longitudinal axis;

c) a drive device, said drive device operably associated with said arched member to cause rotation thereof;

d) a fixing member for movably securing the torso of a user to said arched member whereby selective rotation of said arched member will cause bending of the user's torso in a direction therewith and thereby cause the spine of the user to be therapeutically manipulated;

e) a stretching device operatively associated with said fixing member for causing the torso to be selectively extended along the longitudinal axis of said arched member thereby stretching the same; and f) said stretching device including a pulley secured to said arched member second end and a cable member having first and second ends operatively associated therewith, said cable first end is secured to said fixing member and said cable second end is adapted for selective extension and retraction.

2. An exercising device as set forth in claim 1 and wherein:

a) said fixing member attached to said cable first end including at least one slider device movably secured to said arched member and adapted to freely travel along the surface of said arched member as it rotates, said at least one slider device including a securing member to fix said at least one slider device to the head of a user.

3. An exercising device as set forth in claim 1 and further including:

a) articulated lever member having a first end and a second end;

b) said lever member first end pivotally secured to said arched member second end, said lever member second end attached to said cable member second end; and c) said lever member second end including a hand grip member for allowing the user to manually extend and retract said cable during operation of said exercising device.

4. A therapeutic exercising device comprising:

a) a base member;

b) an elongated arched member having first and second ends, said arched member is movably find to said base member at said first end and generally extends transverse to said base member, said arched member is adapted to selectively rotate at said first end and thereby move said second end through an arcuate path of travel;

c) a drive device, said drive device operably associated with said arched member to cause movement thereof;

d) a fixing member for movably securing the torso of a user to said arched member so that it is positioned substantially parallel thereto whereby selective rotation of said arched member will cause the torso of a user to bend therewith and therapeutically manipulate the user's spine;

e) a stretching device operatively associated with said fixing member for causing the torso to be selectively extended along the longitudinal axis of said arched member thereby stretching the same;

f) said base member includes a seat for supporting a user in a sitting position member, said seat positioned adjacent said arched member first end; and g) tension device extending between said fixing member and said seat to provide tension resistance for said stretching device.

5. An exercising device as set forth in claim 4 and further including:

a) supplemental slider devices provided with respective securing members, said supplemental slider devices are adapted to secure to the arched member the waist, abdomen, chest and head of a user.

6. An exercising device as set forth in claim 4 and wherein:

a) said stretching device including a pulley secured to said arched member second end and a cable member having first and second ends operatively associated therewith, said cable first end is secured to said fixing member and said cable second end is adapted for selective extension and retraction.

* * * * *